US008011165B2

(12) United States Patent
Blahut

(10) Patent No.: US 8,011,165 B2
(45) Date of Patent: Sep. 6, 2011

(54) COMPOSITE ASSEMBLY WITH SATURATED BONDING MASS AND PROCESS OF REINFORCED ATTACHMENT

(75) Inventor: James Michael Blahut, Manahawkin, NJ (US)

(73) Assignee: Integritect Consulting, Inc., Medford, NJ (US)

( * ) Notice: Subject to any disclaimer, the term of this patent is extended or adjusted under 35 U.S.C. 154(b) by 1160 days.

(21) Appl. No.: 11/448,007

(22) Filed: Jun. 7, 2006

(65) Prior Publication Data

US 2007/0283660 A1 Dec. 13, 2007

(51) Int. Cl.
*E04C 2/24* (2006.01)
*E04C 3/00* (2006.01)

(52) U.S. Cl. ..... 52/837; 52/841; 52/847; 442/224; 442/225; 442/373; 442/374

(58) Field of Classification Search ..... 52/837, 52/841; 442/30, 55, 56, 224, 225, 315, 370, 442/373, 374
See application file for complete search history.

(56) References Cited

U.S. PATENT DOCUMENTS 1,299,747 A * 4/1919 McClain ..... 156/313
2,728,702 A * 12/1955 Simon et al. ..... 244/126
3,413,188 A * 11/1968 Allen ..... 428/339
4,186,044 A * 1/1980 Bradley et al. ..... 156/275.5
4,242,406 A * 12/1980 El Bouhnini et al. ..... 442/373
4,500,589 A * 2/1985 Schijve et al. ..... 428/213
4,569,873 A * 2/1986 Robbins ..... 428/106
4,753,837 A * 6/1988 Hanusa ..... 428/86
4,770,929 A * 9/1988 Nobumasa et al. ..... 442/278
4,828,897 A * 5/1989 Staneluis et al. ..... 428/71
5,026,593 A 6/1991 O'Brien
5,068,001 A * 11/1991 Haussling ..... 156/222
5,227,216 A * 7/1993 Pettit ..... 428/113
5,362,545 A 11/1994 Tingley
5,476,704 A * 12/1995 Kohler ..... 428/119
5,501,054 A * 3/1996 Soltis et al. ..... 52/847
5,641,553 A * 6/1997 Tingley ..... 428/114
5,744,228 A * 4/1998 Tingley ..... 428/292.4
5,885,685 A 3/1999 Tingley
5,891,560 A * 4/1999 Edwards et al. ..... 427/434.6
5,910,352 A * 6/1999 Tingley ..... 428/114
6,030,483 A * 2/2000 Wilson ..... 156/292
6,119,422 A * 9/2000 Clear et al. ..... 52/309.8
6,173,550 B1 * 1/2001 Tingley ..... 52/837
6,197,412 B1 * 3/2001 Jambois ..... 428/297.4
6,331,339 B1 * 12/2001 Kajander ..... 428/114
6,565,959 B1 * 5/2003 Tingley ..... 428/292.4
6,592,962 B2 * 7/2003 Edwards et al. ..... 428/114
6,602,810 B1 * 8/2003 Christensen et al. ..... 442/232
6,855,432 B1 * 2/2005 Hojabr et al. ..... 428/461
2003/0148085 A1 * 8/2003 Edwards ..... 428/292.4
2003/0168164 A1 * 9/2003 Blackmore et al. ..... 156/308.2
2003/0221385 A1 * 12/2003 Platt ..... 52/296
2004/0206025 A1 * 10/2004 Panto ..... 52/211
2005/0170166 A1 * 8/2005 Bacon et al. ..... 428/301.4
2008/0233364 A1 * 9/2008 Larson et al. ..... 428/196
2009/0252916 A1 * 10/2009 Heidrich et al. ..... 428/86

* cited by examiner

*Primary Examiner* — Robert J Canfield
(74) *Attorney, Agent, or Firm* — Drinker Biddle & Reath LLP

(57) ABSTRACT

A method of both permanently reinforcing and bonding, by means of a physical connection including a fabric or other arrangement of reinforcing fiber, saturated with a curing liquid resin, and building materials to create a composite assembly is disclosed. Once cured, the previously liquid resin, having surrounded the fiber and features of the surfaces of the elements being joined, combines them within a single, shared resin matrix. The resulting composite assembly incorporates a new method of providing reinforcement from within, and can be formed into any of various products or components in the light construction industry, such as window sashes, millwork, and the like.

14 Claims, 13 Drawing Sheets

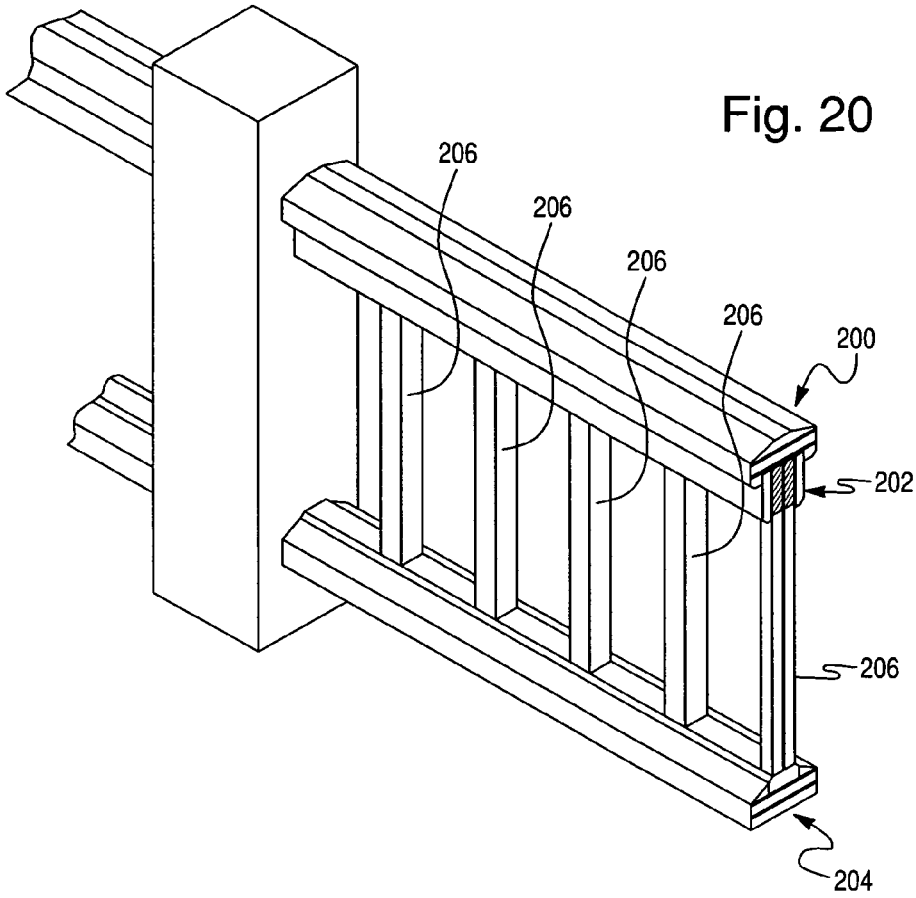
Fig. 20
Fig. 22
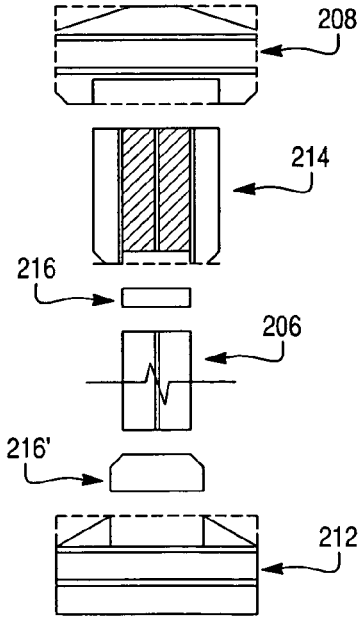

COMPOSITE ASSEMBLY WITH SATURATED BONDING MASS AND PROCESS OF REINFORCED ATTACHMENT

FIELD

The present disclosure relates to bonding and reinforcing materials to form a composite. More particularly, a fabric or other arrangement of reinforcing fiber, saturated with a curing liquid resin, permanently attaches two or more elements, such as a wood-based material and a cellular polyvinylchloride material, to form a composite building material.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

As a replacement to traditional wood products and/or components, plastics and fiber-reinforced plastics have become increasingly dominant as the replacement materials of choice. The reasons for their broad appeal range from their weather resistant qualities, to ease and diversity of manufacturing. Generally speaking, plastics used in the production of construction materials can be grouped into one of two categories. These are thermoplastic plastics (also called thermoplastics) and thermoset plastics (also called thermosets). Thermoplastics dominate the current industry.

The defining characteristic of thermoplastics is that when subjected to heat, they become soft, or plastic. They can be reheated and reshaped many times, or mixed with reinforcing materials prior to cooling as a finished product. This provides advantages for manufacturing processes. However, thermoplastics possess poor structural capabilities. This deficiency has been improved by combining cellulose or other fibers into a molten matrix of common thermoplastics to create composite materials known as fiber reinforced plastics (FRP's) or more specifically fiber reinforced thermoplastics ($FRP_p$'s). The resulting $FRP_p$ composite material, such as TREX™, although improved, remains limited for use in high performance or other structural applications due to the weak linear bonds of a thermoplastic matrix.

Thermoset plastics are permanent or permanently set when cured. These plastics begin as low viscosity resins that, when mixed with a cross-linking curing agent or other means, become permanently solid. They can be formulated to possess a wide range of properties pertaining to resilience, rigidity, weather resistance (weather-ability), and thermal dimensional stability among others. Most often these resins are combined with reinforcing fibers, such as glass or carbon. The addition of fiber reinforcement to thermosetting plastics greatly improves tensile properties and thermal characteristics. The resin matrix impregnates these high strength fibers and distributes applied stresses to them.

Most applications of fiber reinforced thermoset plastics ($FRP_s$'s) focus on developing lighter, stronger, and more durable products. $FRP_s$ technology has created very strong and versatile materials. Although having superior performance properties, $FRP_s$ technology has not been incorporated into the residential/light construction building industries. In the current market, few, if any, manufacturers consider combining these high tech, high performance composites with inferior materials such as wood or thermoplastics. Although fiber reinforced thermoset plastics, such as fiberglass, provide extremely desirable performance qualities, they lack the look and feel of traditional construction materials, such as wood. Further, once cured, they are difficult to shape, modify or otherwise work with (work-ability) in the field, as is necessary in many conventional uses, such as constructing millwork or detailed areas of buildings.

Several techniques of creating and/or applying $FRP_s$ have been implemented in the fabrication of building materials and products. All of the following methods use the fiber-reinforced plastics as a laminated veneer and/or as a visible or exposed component of the final structure. Both the aesthetic qualities of a "plastic" appearance and lack of its ability to be modified after cure limit the considerations of using this type material for many products and end uses. One method laminates a single or several layers of resin impregnated fiber fabric (known as lay-up) over an existing mold, wood frame, or other structure. After curing, the fabric can remain attached as a reinforcing and/or weather resistant veneer, or can be removed using a release agent. Another method uses a slurry-like mix of short fibers and thermoset resin that is dispensed over forms or molds, using a compressed air gun nozzle or "chop gun". The mix can be dispensed to a varying thickness, and cured using a time dependant, heat sensitive or radiation sensitive catalyst. Once cured, they also may be removed from the form or mold making using a release agent. A more current application that combines saturation and curing is called pultrusion. Pultrusion is the pulling of continuous fibers through a resin bath, and then immediately passing these saturated fibers through a heated die that initiates a heat sensitive curing process. The die, ranges in geometry from basic to elaborate profiles. One application of pultrusion produces flat strips. The cured strips then have one surface roughened or otherwise abraded in order to enable adhesives to bond adequately. This is necessary due to the smooth, rigid surface conditions of the encapsulated fibers of the cured strip. They are then laminated, as a means of reinforcement, to exterior portions of the beam that experience high stresses using known adhesives, such as resorcinol (see, for example, U.S. Pat. Nos. 5,362,545 and 5,885,685).

It is commonly understood certain difficulties occur when combining rigid, planar materials by means of adhesive attachment. The less refined the surface, the more difficult it is to achieve adequate contact, thus a strong and consistent bond. On the other hand, the more surface area in contact, the better the bond. However, a higher degree of refinement, e.g., preparation of the surface, is often associated with increases in time, costs, and other resources. Also, unless the surfaces being bonded are refined to be perfectly uniform, they only come into contact along protruding portions. Therefore, the remainder of the surface area remains either a void, or when possible, filled with excess adhesive.

Several methods exist to add reinforcement to an element. One typical approach is to identify a reinforcing material that exhibits the desirable performance characteristics and laminate it, using high strength adhesives, between layers of the substrate material being reinforced. The most limiting factor is to select a reinforcing material that will not adversely affect the ability to cut or otherwise modify the end product using common tools and methods. One such case uses a strip of high strength aluminum to reinforce a beam made of many laminations of wood strips (see, for example, U.S. Pat. No. 5,026,593). Another example includes using a formed strip of fiber reinforced thermoset plastic. The metal and $FRP_s$ strip are very strong yet able to be worked with in the field. However, the reinforcing material must be treated in various ways to insure an adequate bond. The aluminum must be cleaned, abraded, and chemically treated to resist oxidation before it can be used as reinforcement, or the material with fibers is abraded to "hair-up" the outermost fibers by removing the outer portions of the surrounding cured resin. In either case, the composite consists of at least an outer layer of substrate material, a coating of adhesive, a strip of reinforcing material, a second coating of adhesive, and the second outer layer of substrate. In many cases, failure does not occur from the rupturing of the reinforcement, but rather from a sheer failure along the adhesive plane bonding the elements together. In the case of the aluminum, at failure the metal "pops" free from the adhesive. This is due to the lack of surface area for even a treated strip. The fiber-based reinforcement, although having better surface characteristics, is still limited by the adhesive bond. This is due in part to the inferior bond of a resin (adhesive) to resin (fiber reinforced plastic matrix) connection. The overall bond strength depends on the adhesive coating penetrating the "haired-up" fibers that comprise only a portion of the surface area. In effect, the weak link joining the composite can be considered a "resin matrix discontinuity".

SUMMARY OF THE INVENTION

A method of both permanently reinforcing and bonding, by means of a physical connection, building materials to create a composite assembly is disclosed. Exemplary embodiments of the method uses a fabric or other arrangement of reinforcing fiber, saturated with a curing liquid resin as the means of permanently attaching two or more elements. This suspension-like combination of fiber and liquid is to be considered a "saturated bonding mass" or SBM, which takes the place of a simple, traditional coating of adhesive as well as being a reinforcement material. Once cured, the previously liquid resin, having surrounded the fiber and features of the surfaces of the elements being joined, combines them within a single, continuous, shared resin matrix. Separating the combined elements physically removes portions of material that have become embedded in the resin.

Although this process may be modified to accommodate variations in the particular characteristics of each component being combined, it provides a procedure for combining and reinforcing two or more elements in a manner that achieves an advanced connection. An exemplary embodiment of this technique, referred to in this text as "reinforced lamination", uses alternating sheet-like layers of building materials (substrates) and a SBM comprised of woven fiber fabrics encased in a thermoset resin matrix to produce composite assemblies to be used as products or components in the light construction industry, such as window sashes, millwork, and the like.

An exemplary embodiment of a composite assembly comprises an essentially, planar first outer substrate, a first reinforced lamination layer, an essentially planar inner substrate having an open cellular structure, a second reinforced lamination layer, and an essentially planar second outer substrate, wherein the first reinforced lamination layer joins a prepared surface of the first outer substrate to a first surface of the inner substrate, wherein the first reinforced lamination layer includes a plurality of reinforcing fibers and a thermoset resin, the thermoset resin forming a single continuous matrix encasing the plurality of reinforcing fibers and surface features of the prepared surface of the first outer substrate and permeating into a portion of the open cellular structure of the inner substrate, wherein the second reinforced lamination layer joins a prepared surface of the second outer substrate to a second surface of the inner substrate, and wherein the first reinforced lamination layer includes a plurality of reinforcing fibers and a thermoset resin, the thermoset resin forming a single continuous matrix encasing the plurality of reinforcing fibers and surface features of the prepared surface of the second outer substrate and permeating into a portion of the open cellular structure of the inner substrate.

An exemplary embodiment of a method of assembling a composite assembly comprises preparing a surface of a first substrate, positioning a first substrate in a staging area with the prepared surface exposed to receive a coating including a resin and a catalyst, applying the coating to the prepared surface of the first substrate, manipulating the coating on the prepared surface, laying at least a first ply of fabric on the coating and saturating the first ply, coating a prepared surface of a second substrate with a coating including a resin and a catalyst, mating the coated surface of the second substrate to the coated and plied surface of the first substrate, applying a pressure to the mated substrates, and curing the coating.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which:

FIG. 20 is a cross section view of profile 17 that is created by removing portions of composite blank 12 and is an exact geometric replica of profile 16. It should be noted that the placement of the $FRP_s$ layers is such that the composite blank is modified with minimal interference, while providing strategic placement for maintaining and enhancing product performance.

FIG. 22 shows the railing components arranged in the railing system.

DETAILED DESCRIPTION

In an exemplary embodiment of a composite assembly, the composite assembly comprises components including one or more substrate layers and one or more fiber reinforced thermoset plastic ($FRP_s$) structural laminating layers. An assembly of alternating layers, being of like or differing substrates and $FRP_s$'s, are both bonded and reinforced by means of a mechanical attachment. Further, in one exemplary process, the reinforcing fiber, activated thermoset polymer resin, and both layers of substrate are combined in an integrated process in such a way so as to create a composite that performs as a single, permanent material. This is achieved by the physical "anchoring" or "fusing" created when the excess liquid resin of a fiber saturated bonding mass ("SBM") is forced into, or otherwise fills the void spaces of the porous, permeable outermost portions of a prepared surface (as described below) prior to curing. Once cured, the previously liquid resin surrounds the fiber and the portions of the surfaces of the substrates above and below, in effect combining them within a single resin matrix. Separating the combined components physically rips off portions of the substrate(s)and/or fiber that have become embedded in the resin.

Figure 1:
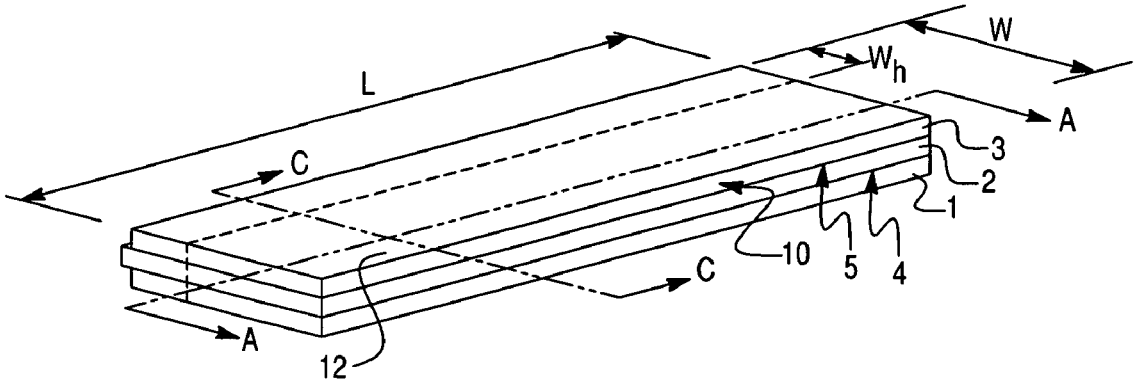
FIG. 1 is a schematic representation of an exemplary embodiment of a composite assembly.

FIG. 1 is a schematic representation of an exemplary composite assembly 10 (measuring width W and length L) including a bottom (one of two outer layers) substrate layer 1, a first reinforced lamination layer 4, an inner substrate layer 2, a second reinforced lamination layer 5, and a top (second of two outer layers) substrate layer 3. Although represented as three substrate layers with intervening reinforced lamination layers, it should be understood that any number and sequence of substrate layers and reinforced lamination layers could be used to form a composite assembly.

Substrates are to be considered any material that is cellular in nature or can have its surface prepared in such a way so as to provide a "fused anchoring" (as described herein) of a low viscosity thermoset plastic. Additionally, these substrate materials can be manufactured or processed into sheets, panels, or boards being of organic or inorganic origins. Depending on the design specifications of the end product, the substrate(s) chosen may be of differing thickness and composition of materials.

In many instances the substrate is selected to provide certain desired physical and visual qualities to the composite assembly, often most relevant when positioned at the visible layers of the composite. These qualities include, but are not limited to, a material's ability to be machined or otherwise modified using common carpentry tools, methods, and generally understood construction techniques (e.g., workability), as well as specific desirable visual (aesthetic) qualities, and having a certain touch and/or feel, and consistency (density and texture). That is not to say that a substrate cannot or should not maintain structural properties of their own, but rather not necessarily as the primary source. Further, substrates are generally both less dense and less expensive than the $FRP_s$ components. If, for example, it is determined the performance requirements of a particular product can be achieved using only 20% of the cross sectional area as $FRP_s$, the remainder is to a large extent filler material. Using more $FRP_s$ than is necessary increases costs, reduces workability, and may create a product with undesirable density and handling issues.

Substrate materials can be generally grouped into two categories. One category of materials for substrates is derived from common materials that exist in the current market. Possible substrates of this type may be, but are not limited to, cellular thermoplastics (i.e., AZEK™ trim or other cellular PVC), fiber reinforced thermoplastic ($FRP_p$), (i.e., Trex™), unaltered wood products, or modified wood products such as laminated veneer lumber (LVL), oriented strand board (OSB), medium density fiber board (MDF), high density fiber board (HDF), among others.

A second category of materials that can be used as substrates are those designed and fabricated for the purpose of "reinforced lamination". An example includes a preformed sheet of cured $FRP_s$, where the manufacturer creates a lay-up or pultrusion process to produce a sheet of fiber. Once cured, this sheet could optionally undergo surface preparation prior to use in the reinforced lamination process, for example for a high performance structural product, in the same manner as any more conventional substrate is used i.e., being combined to other substrates using a SBM. This would allow more complex fiber configurations to be achieved without the need for all the fiber components to be part of or at the same location as the lamination process itself.

Another example of a substrate material produced by the reinforced lamination process may be an inner or core substrate. Substrates placed in interior layers, for example, the inner substrate layer 2 of FIG. 1, can be made from different materials from the outer substrates, such as bottom substrate 1 and top substrate 3 of FIG. 1. These inner layers do not require the same aesthetic and work-ability characteristics as outer, high quality layers. An exemplary substrate used as an inner substrate is one that is produced from thermoplastic particle or flake-like debris, for example, resulting from the preparation process, or other recycled substances. The debris or other recycled material can be ground up and mixed with a thermosetting resin and/or short fibers, spread into a desired geometry, e.g., a flat sheet and allowed to cure. A material produced from these components can be cut or otherwise modified into a substrate sheet to be used in the reinforced lamination process, for example, to be used as an inner substrate layer in a composite assembly.

Figure 2:
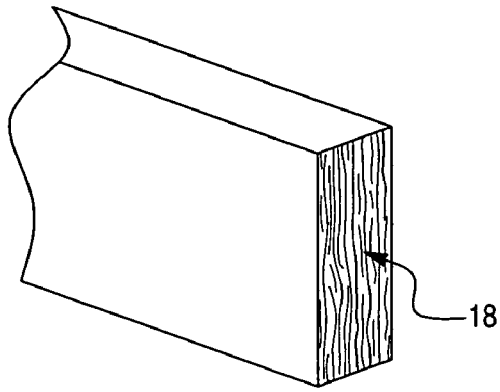
Fig. 2 Prior Art
FIG. 2 illustrates a typically prior art beam profile.
Figure 3:
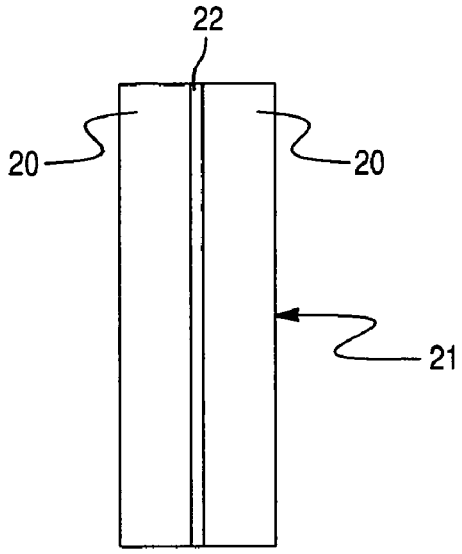
FIG. 3 is a schematic representation of an exemplary embodiment of a beam formed from a composite assembly.
Figure 4:
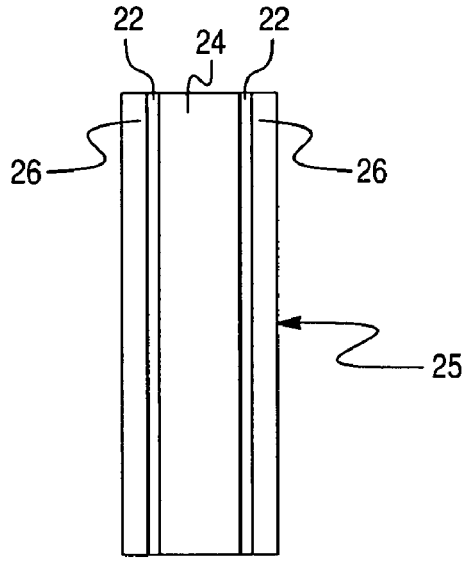
FIG. 4 is a schematic representation of another exemplary embodiment of a beam formed from a composite assembly.

Further, a core substrate serves a geometric role with respect to performance. It occupies volume, and provides the mechanism to allow for the strategic placement (orientation) of the $FRP_s$ layers with respect to one another, such as separation. This may be deemed necessary to best achieve the desired performance characteristics. For example, consider a beam profile measuring +/− 2"×+/−8", such as beam 18 of FIG. 2, to be used in the construction of a nominal load bearing application such as an arbor or pergola. Two different composite assemblies that would provide these dimensions could be, as represented in FIG. 3, a single layer of $FRP_s$ 22 between two, one inch thick layers of substrate 20, or as represented in FIG. 4, a one inch core of substrate 24 combined on both sides with a layer of $FRP_s$ 22 and a half inch layer of substrate 26. Being a beam, both assemblies are arranged such that the $FRP_s$ layer(s) are oriented vertically, similar to a steel flitch plate. However, the first example (the composite assembly 21 of FIG. 3) would provide far less torsional strength than the second example (the composite assembly 25 of FIG. 4) in that the reinforcement in the composite assembly 21 is located at the neutral axis. In the composite assembly 25 of FIG. 4, the core substrate 24 provides improved performance properties by separating the $FRP_s$ layers 22 in effect by moving the $FRP_s$ layers from of the neutral axis toward the outer surfaces. Thus, the orientation of layers with respect to one another, not just what materials and how much of each is present plays a significant role in performance.

Another component of an exemplary composite assembly 1 is the reinforced lamination layer(s). This component, defined earlier herein as a saturated bonding mass (SBM), is a $FRP_s$ layer which may include glass, carbon or other fibers most often arranged in a woven fabric or pressed matt embedded in a cured polyester, epoxy or other resin. This surrounding substance protects the fibers and distributes the applied stresses to the fibers. Equally relevant, the resin "anchors" itself into the pores or other open structures of the prepared substrate surface creating a permanent physical connection.

It is generally understood that $FRP_s$'s are very hard substances and once cured are difficult to cut or modify (i.e., have low workability). In instances where moderate workability characteristics of the overall composite are desired, the reinforced lamination layer(s) may be thin (⅛", +/−1/16"), and separated by the highly workable substrate layers of varying thickness. Optionally and were applicable to minimize adverse workability issues, the placement of the reinforced lamination layer(s) within the composite assembly are strategically located in areas requiring minimal modification (as is the case with examples disclosed herein such as the window sash frame example, among others).

The reinforced lamination layer(s) provides the composite assembly with one or more improved physical or performance properties as compared to, for example, an equally sized component that consists of only a single substrate or basic combination of substrates, e.g., a multilayer formed of multiple wood-based materials. Depending on the desired performance specifications, the $FRP_s$ layer can optionally be formulated to achieve a wide range of characteristics. These include but are not limited to: a composites modulus of elasticity, maximum fiber stress, sheer strength, thermal coefficient of linear expansion, torsional rigidity, resilience with respect to temperature (for example, brittle when cold, ductile when hot) and dimensional stability with respect to moisture. Adjusting or changing either or both of the fiber and/or liquid polymer resin component of the $FRP_s$ layer in the reinforced lamination layer(s) can achieve these properties.

The curing liquid thermoset polymer resin is the binding component in the reinforced lamination layer(s). It provides a single matrix in which both the reinforcing fibers as well as the anchored portion of the substrate layers are contained. The viscosity of the resin is generally low in that the more fluid-like the resin, the better it surrounds the elements being combined. When applicable, the polymer may be selected to chemically bond to the substrates to enhance bond strength. Variations of this component may be, but are not limited to: the viscosity of the fluid, the pigment (if any), the structural/performance properties of the cured resin, the mechanical properties of the cured resin, chemical properties of the liquid resin, or the means by which the cross linking process is initiated (IE catalyst) whether it be time, temperature, or radiation dependant.

The fiber is the reinforcing component between two layers of substrate. It may be used in the form of a pressed mat, woven fabric, individual fibers, or other arrangements. These fibers, substantially stronger than the resin, are embedded in a matrix of the resin. The length and orientation of the fiber direction are determined by the design specifications of the end product. For example, an element used in bending, such as a beam, may require unidirectional fibers of long or continuous length, whereas a sheet product may require shorter, multi-directional fibers. Differing applications of the $FRP_s$ component contained in a particular reinforced lamination layer of a composite assembly may be, but are not limited to: individual fibers or a pre-assembled ply of mat or fabric of fibers, the gauge or density (weight per unit area) of a ply of mat or fabric, the number of plies of mat or fiber, the orientation of the fiber, the length of the fibers or the type (i.e., glass, carbon, cellulose) of fiber used.

Further, the characteristics of the saturated fiber provide an additional benefit with respect to the reinforced lamination process. The fiber occupies space within its' respective layer. The fiber fabric or matt, when saturated, swells like a sponge holding the liquid in place prior to curing. The fiber allows the laminating layer to maintain a greater thickness than a low viscosity resin or adhesive is capable of without being contained. The saturation of the fibers can be achieved using any known method. The swollen fiber composition attains the ability to compress and conform to surface irregularities. This slight variation in thickness accommodates deviations that may exist throughout the surface of the substrates. This allows a more complete union between the upper and lower layers of substrate and thus a more perfect bond.

Figure 5:
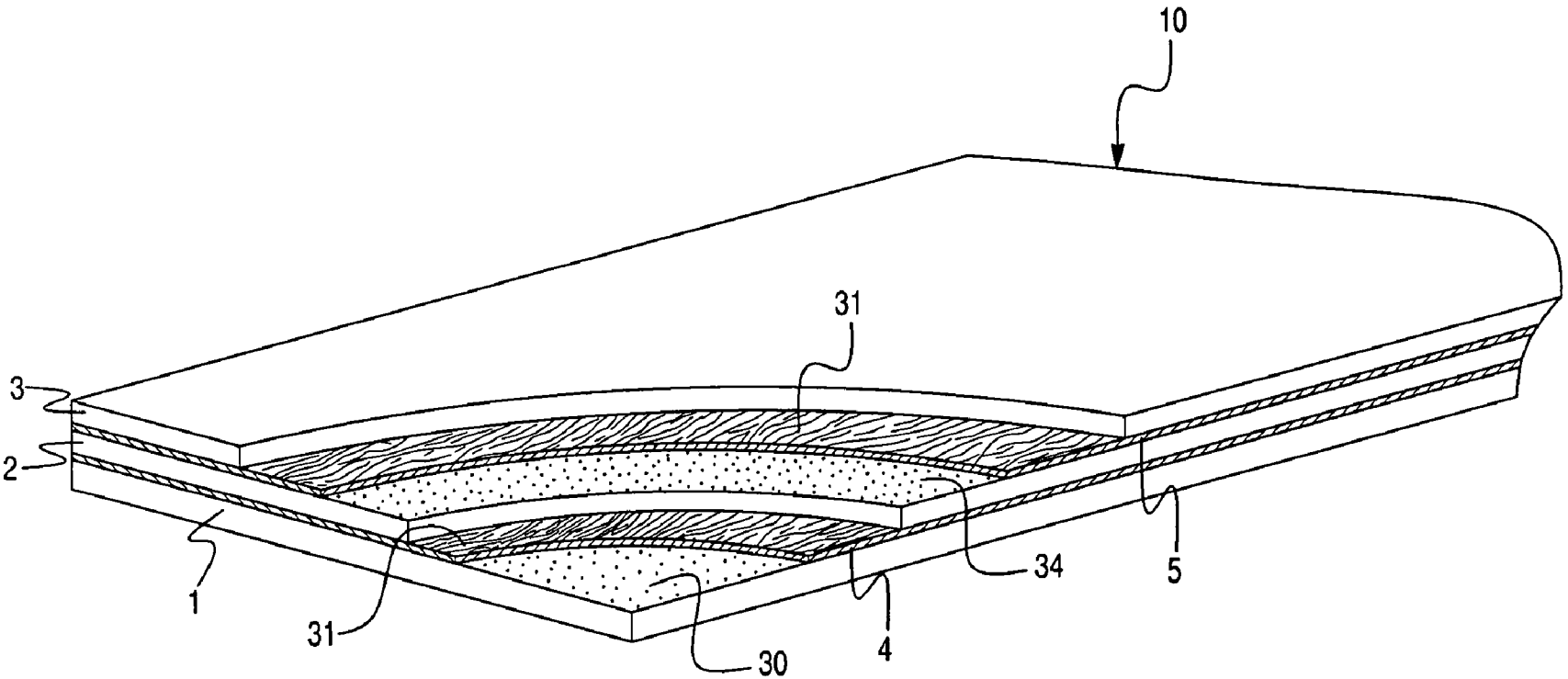
FIG. 5 is a schematic representation of a cut-away view of the exemplary composite assembly 10 of FIG. 1 showing its different layers.

FIG. 5 is a schematic representation of a cut-away view of composite assembly 10 showing its different layers. In an exemplary embodiment of composite assembly 10, bottom (one of two outer layers) substrate layer 1 can be, for example, a 11/16" thick prepared sheet of clear Douglas fir lumber, measuring ±12-0'×±24", having its graining oriented generally parallel to its long dimension. The first and second reinforced lamination layers 4, 5 can be, for example, $FRP_s$ having two plies of 7 oz. woven unidirectional fiberglass fabric having a fiber 31 orientation generally parallel to a long dimension and encased in a cured thermoset polyester resin 32. Inner substrate layer 2 can be, for example, a 11/16" thick filler or core material consisting of ordinary, less consistent cellular thermoform plastic or recycled plastic particle, as described herein, substrate and measuring ±12-0'×±24". Top (second of two outer layers) substrate layer 3 can be, for example, a high quality CPVC such as is manufactured by AZEK TRIMBOARDS.™ FIG. 5 also illustrates the optionally prepared surface 30 of bottom substrate 1 and inner substrate layer 2 on which the reinforced lamination layer is laid prior to curing.

Figure 6:
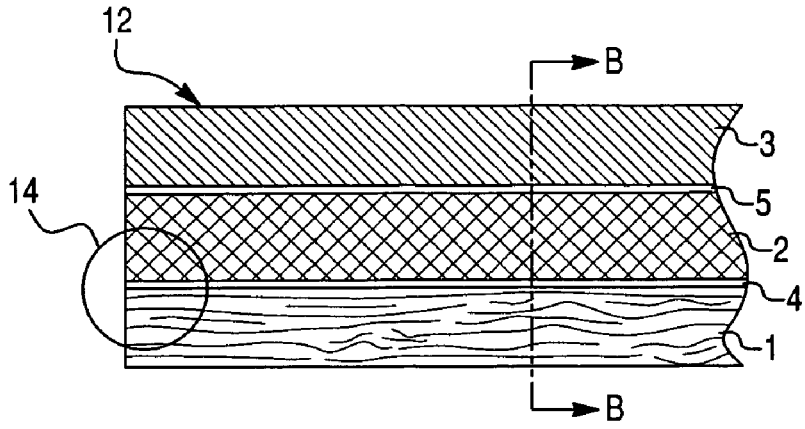
FIG. 6 is a schematic representation of a partial side view of a cross section of an exemplary strip cut from or otherwise removed from the exemplary composite assembly of FIG. 1, as seen along (A-A).
Figure 7:
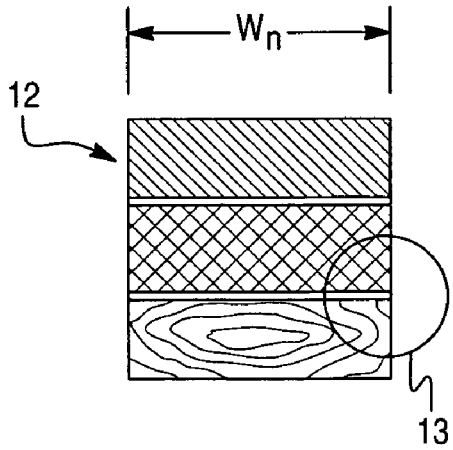
FIG. 7 is a schematic representation of a partial cross section view of the exemplary strip of FIG. 6, as seen along (B-B).
Figure 8:
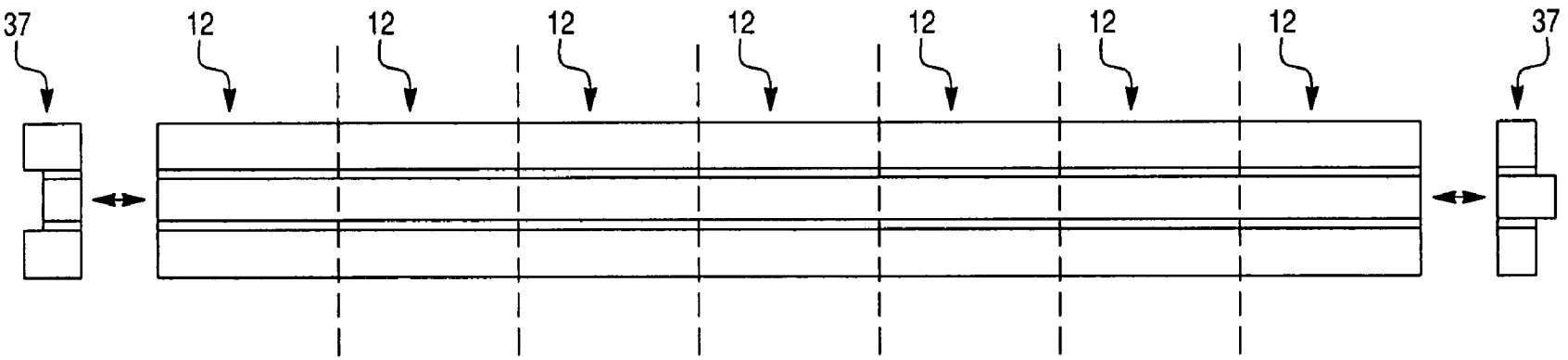
FIG. 8 is a schematic representation of an exemplary composite assembly 10 seen as along (C-C) in FIG. 1, illustrating the assembly cut in the direction of its length to create multiple strips.

FIG. 6 is a schematic representation of a partial side view of a cross section of strip 12 cut from or otherwise removed from the assembly 10 of FIG. 1 as seen along (A-A). Strip 12 has the thickness and length of assembly 10 and width $W_n$. FIG. 7 is a schematic representation of a partial cross section view of the strip 12 of FIG. 6 as seen along (B-B). FIG. 8 is a schematic representation of assembly 10, seen as along (C-C) in FIG. 1 and showing additional strips 12 formed by additional cuts of composite assembly 1. Each of FIGS. 6, 7 and 8 illustrate the assembly cut in the direction of its length to create strips 12. The end portions 37 of assembly 10 are optionally removed to insure consistent compositions of each strip 12. Strips can be sized as blanks for subsequent working by lathes, routers, and so forth to form detailed construction products such as millwork.

Figure 9:
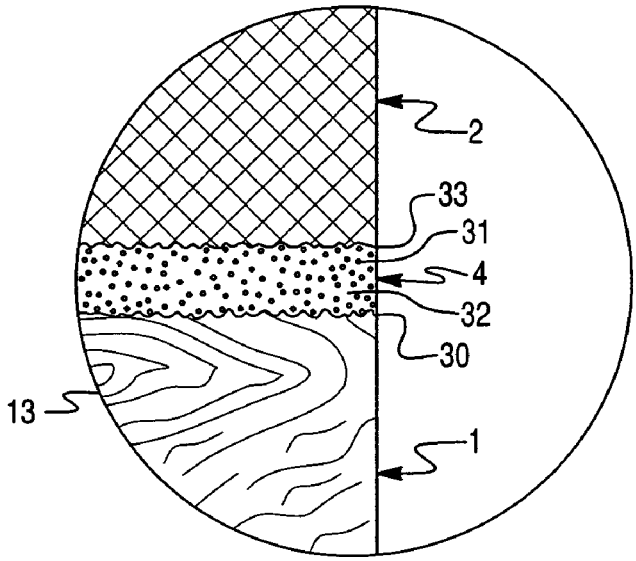
FIG. 9 is a schematic representation of a magnified detail view of a region 13 of the strip shown in FIG. 7.
Figure 10:
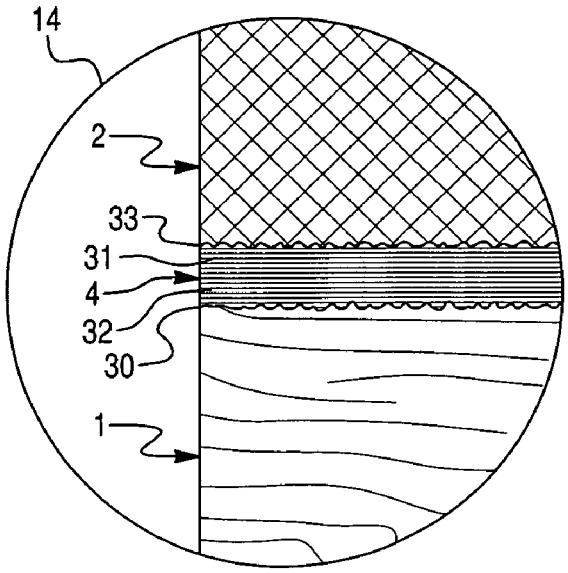
FIG. 10 is a schematic representation of a magnified detail view of region 14 of the strip shown in FIG. 6.

FIG. 9 is a schematic representation of a magnified detail view of a region 13 of assembly 12 shown in FIG. 7. This view shows the reinforced lamination layer 4 and the ends of the reinforcing fibers 31 oriented perpendicular to the cut plane, however, the orientation of the reinforcing fibers 31 can vary with differing applications. As seen in FIG. 9, the thermoset resin 32 permeates the prepared surface 33 of inner substrate layer 2 and the prepared surface 30 of bottom (one of two outer layers) substrate layer 1 and encases the reinforcing fiber 31 joining the prepared surface 33 of inner substrate layer 2, the prepared surface 30 of bottom (one of two outer layers) substrate layer 1 and the reinforcing fiber 31 within a single matrix FIG. 10 is a schematic representation of a magnified detail view of region 14 of assembly 12 shown in FIG. 6. This view shows the reinforced lamination layer 4 and the length of the reinforcing fibers 31 oriented parallel to the cut plane, however, the orientation of the reinforcing fibers 31 can vary with differing applications. As seen in FIG. 10, the thermoset resin 32 permeates the prepared surface 33 of inner substrate layer 2 and the prepared surface 30 of bottom (one of two outer layers) substrate layer 1 and encases the reinforcing fiber 31 joining the prepared surface 33 of inner substrate layer 2, the prepared surface 30 of bottom (one of two outer layers) substrate layer 1 and the reinforcing fiber 31 within a single matrix.

An exemplary method of reinforced attachment using a saturated bonding mass (SBM) is reinforced lamination. Lamination in this case refers to the bonding together of (thin) layers of material to form a built-up composite material. Reinforcement refers to the introduction of fiber plies within. Reinforced lamination is a process that achieves both.

The exemplary method to form a composite assembly uses common building materials (cellular and/or friable materials such as wood and many plastics) and reinforcing fiber, such as fiberglass or carbon fiber, in combination with low viscosity thermosetting resins. The method does not require an environment that exceeds normal or common atmospheric pressure and temperature. The method of attachment not only combines various building materials, but also provides reinforcement to the resultant composite assembly. The adhesive layer serves as a matrix to allow for simple to complex arrangements of fiber reinforcement to be introduced into the composition of the final composite assembly.

The characteristics of a saturated fiber provide additional benefits. For example, the saturated bonding mass (SBM) has a pliable nature, allowing the saturated fiber to vary slightly in thickness and to conform to the surface to which it is being bonded. Due to this characteristic, there is less pressure required to insure adequate contact between surfaces, thus less refinement (e.g., surface preparation) required (when applicable).

In another example, gaps between the surfaces can be spanned where necessary, by adjusting the viscosity of the bonding medium. However, to gain the full benefit of the fiber strength of a saturated bonding mass, the fibers must be fully encapsulated in the curing polymer matrix. This is best achieved using a low viscosity resin. A low viscosity also enables a higher degree of penetration into the surfaces it is being bonded to. It is this infiltration that, once cured, anchors the resin both within the fibers and to the surfaces. Therefore, choice of viscosity of the resin is balanced between low viscosity and high viscosity. In one exemplary embodiment, the fiber of the saturated bonding mass is saturated. When the fiber is saturated, the surface tension between the fluid surrounding each fiber or suspended solid keeps the fluid from spreading freely. This "suspension" can maintain a thickness greater than an unconstrained fluid alone. By using a low viscosity curing resin in combination with suspended fibers, the adhesive penetration is maximized without loosing the ability to maintain an adequate thickness needed to bridge a reasonable separation distance, e.g. up to 3/16".

When combining two or more elements using this method, a coating of bonding agent, such as a curing polymer resin, is applied to each surface being combined. Typically, the bonding agent fills as large a percentage of voids and other surface imperfections as is reasonably practical. This may be facilitated by external means, as described herein. For example, a doctor blade or other straight edge can be moved across the surface. Prior to curing, fiber of any possible type and/or configuration is placed on one or both coated surfaces. The fiber is also saturated with the curing resin. This can be carried out in place or at a separate location prior to placement.

Once placed, the saturated bonding mass may optionally be manipulated to remove trapped air pockets and to bring a layer of resin to the surface. Manipulation can include any physical, mechanical or other means to remove trapped air pockets and to bring a layer of resin to the surface. For example, a roller, either with a smooth surface or an irregular surface, can be rolled across the surface of the saturated bonding mass. Irregular surfaces include surfaces with raised protrusions, surfaces with raised ridges and surfaces with indentations, such as holes or channels. In another example, pressure waves or sound waves, such as ultrasound, can be used to remove trapped air pockets and to bring a layer of resin to the surface.

Subsequent to placement and optional manipulation, the treated surfaces are put into contact, applying enough pressure to achieve an adequate bond, in effect forcing the surface coatings of the materials being combined and the resin of the SBM together into a unitary bonding matrix. It should be noted that when placing the two substrates together a method should be used so as to minimize trapped air. For example, the entire sheet can be suspended above the base material using a separator such as strips of wood or dowels. One edge is allowed to make contact and is pressed firmly into place. The next closest separator is then removed and additional area of substrate is allowed to make contact. The process is repeated along its length until the entire substrate is set. Such a process is important in that once the layers are combined, trapped air will be difficult to remove and may decrease bond strength. The components of the composite assembly can be held in place, when necessary, using common methods, such as a clamp or press, until the activated resin is fully cured. Once cured, the components are permanently combined into a single composite assembly.

Composite assemblies formed by the exemplary method described as reinforced lamination provides an economical means to mass-produce smaller desired product geometries, such as a strip as represented in FIG. 8, by cutting them from a larger arrangement of materials first formed as a single sheet of composite assembly. Rather than simply holding the layers of substrate together, the $FRP_s$'s also become an integral part of the composite assembly strips. Each strip, having the same composition allows for the strategic placement of a structural reinforcement within the composite at areas of high bending or other fracture stresses. It is these composite strips that replace common existing building materials, currently often being of homogenous substances, such as wood.

Reinforced lamination and composite assemblies formed by reinforced lamination can improve and/or can replace certain types of building materials. Although the process can be applied to other areas of industry, it is described herein as it pertains to materials used for manufacturing components of buildings or similar structures, such as common structural elements and components of the exterior envelope of buildings. The resulting composite assembly acts as a single material with the combined qualities of the substances used in its formation. More specifically the composite assembly displays stability, endurance, resilience and other performance capabilities of permanently set reinforced plastics and mimics the workability and aesthetic qualities of many wood species while using cellular or fiber reinforced thermoplastics, and/or other non-wood-based substrates.

Exemplary composite assemblies may be used for products that can be improved upon such as: window sashes and frames, exterior entry or garage doors, exterior storm shutters, exterior railings, porch elements, laminated veneer lumber products, such as flanges of wood I-joists, among many others. The exemplary composite assemblies may be used as a component that in itself makes up a product (i.e. railing baluster), or it may be a one of several components that make up a more complex product (i.e. window sash frame). The process enables retention of desired physical and aesthetic characteristics of a particular substrate(s) while improving structural characteristics and overall performance as an end product. The resulting composite assembly can be implemented into present day industries using existing tools, equipment, procedures, skills and techniques.

Exemplary composite assemblies integrate the reinforcing component of a composite material into the structure. Placement of the $FRP_s$ reinforcement may be provided in a calculated and strategic manner for a number of specific purposes; 1) to create a reinforced "groove"; 2) to create a reinforced "tongue"; 3) to provide increased resistance to bending, shear, or other deformation in areas of high or concentrated stress; 4) to improve torsional rigidity; and 5) to improve the thermal linear coefficient of expansion and contraction. In doing so, the composite assembly does not look like a plastic material or product because the reinforcement is accomplished by incorporating the $FRP_s$ within the composite assembly rather than being exposed at a finish surface of the composite assembly. By finish surface, one is referring to a surface that, in the constructed feature, is typically visible to a person viewing the constructed feature, although some applications of composite assemblies may minimally expose the $FRP_s$ at a secondary visible surface (as opposed to a primary visible surface).

The intent of reinforced lamination is to replace current materials with composite assemblies of similar mass and scale, having improved aesthetic, physical, and/or performance characteristics. To illustrate this concept, a similar approach to the location of reinforcement is a beam that incorporates a steel flitch plate. In this case, a wood beam that would otherwise be solid or built up from several thinner members, is made stronger with respect to increased load carrying capacity and reduced deflection when loaded, without the need of having increased dimension. Equally importantly, the reinforced beam can be easily used in the existing construction process. In its simplest application a thin steel plate (+/−½") is sandwiched between two wood planks or boards and secured using bolts. If necessary, multiple plates can be assembled. Having the wood components remain on the outside allows other building components to be combined or otherwise attached to the sandwich-beam without the need for different tools or techniques. In this case, a product is made stronger without the need to increase dimension or drastically reduce the ease to which it can be incorporated into the construction of a common building.

An exemplary method of forming a composite assembly comprises preparing a surface of a first substrate, positioning a first substrate in a staging area with the prepared surface exposed to receive a coating of resin and catalyst, applying the coating of resin and catalyst to the prepared surface of the first substrate, manipulating the coating on the prepared surface, laying at least a first ply of fabric on the coating, saturating the first ply, optionally rolling the first ply and optionally laying at least a second ply of fabric on the saturated first ply and saturating the second ply, coating a prepared surface of a second substrate with a coating of resin and catalyst, mating the coated surface of the second substrate to the coated and plied surface of the first substrate, applying a pressure to the mated substrates and curing the coating. The method may be repeated for any number of layers of materials to be joined into the composite assembly. Alternatively and/or additionally, a manufacturer may coat each of the two surfaces to be mated and apply at least one saturated ply to each surface prior to mating.

Preparing a surface of a first substrate includes refining the surface. Here, the condition of the substrate is considered at two scales, large (macro) and small (micro). The macro condition is to be considered the entire substrate plank and/or sheet product. They should be essentially planar, e.g., relatively flat and even, to allow reasonably consistent contact between the materials being combined. It should be noted that the macro condition of the substrate is simply a refinement issue and may vary depending on the components being combined. The micro condition is to be considered the cellular surface structure. A substrate with its outer surface being closed cells or tightly packed and or (crushed/compressed) cells, may be modified in such a way so as to create an abraded, roughened, and permeable open-celled surface. The purpose of this modification is to improve it's bonding. The resulting flat, uniform and abraded surface is to be considered herein as a "prepared surface" for the lamination process. Unless a particular substrate is naturally rough, abraded etc., all surfaces being joined by the SBM will have improved adhesion if prepared. If however, through simple experimentation, it is determined a substrate surface naturally accommodates adequate bond strength and no benefit exists to "over design" the bond strength of a particular composite, further refinement can be considered a waste of time and other resources.

As a means of preparation, many different techniques may be used to remove and/or roughen the surface of varying substrates. Suitable methods are dependant on the specific characteristics of a particular substrate and can be determined by remedial experimentation. These include, but are not limited to: roughening agents for cellular thermoplastic sheets or surface roughening agents, such as powders, that are spread over the surface of an extruded sheet while still hot. Other methods may be chemical treatment, the removal of the outer surface (e.g., +/−1/16") by using a smooth or corrugated rotary blade surface planer, simple abrasion (e.g., sanding), or physically separating a substrate into two or more thinner sheets. This method can be achieved by cutting with a blade such as a horizontally oriented band saw blade.

Once the composite assembly is formed, additional methods can be used to prepare particular sizes or geometries from the composite assembly. For example, and with reference to FIG. 8, a strip (also called a blank) can be formed from the composite assembly by trimming the edges of the formed composite assembly and then cutting the sheet of composite assembly into a plurality of strips. The strips can be further processed by wood working tools to form profiles, such as millworking profiles for trim and other applications.

The composite assembly can be formed into a variety of structures. For example, the composite assembly can be formed into a window sash frame. In other examples, the composite assembly can be formed into a railing assembly, a porch rafter assembly or an I-beam among others.

The desired properties and qualities of the end product dictate the components combined to create the composite. These include the selection of the curing polymer resin, reinforcing fiber and substrates to be used based on a particular set of design specifications. These components are prepared and combined in a specific layered arrangement to create various composite assemblies. Once complete, the highly variable arrangements allow the new composites to be crafted into one of many different end products and uses.

In one example, the fiber ply used in the method to form a composite assembly can be customized to a specific use. Fibers of the ply can be oriented (uni-directional) or can multi-directional and a single layer of ply may have a mixture of uni-directional and multi-directional fibers. Further, different portions of the reinforced lamination layer may have different types of ply (e.g., have one or more of different fiber types, number of layers, density, orientation, and so forth).

Figure 11:
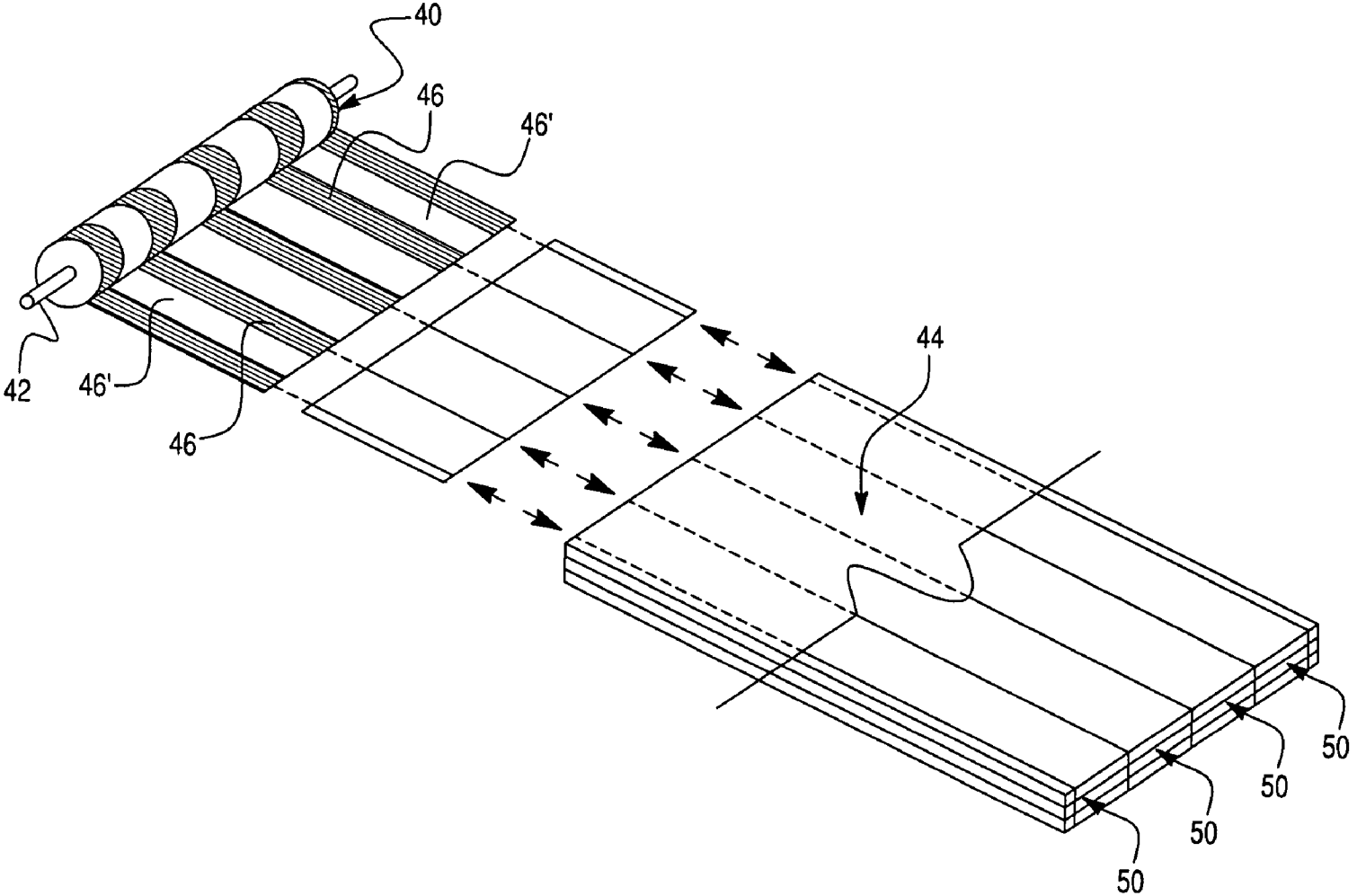
FIG. 11 is a schematic representation of a customized ply incorporated into a composite assembly, which is then processed into a strip.

FIG. 11 is a schematic representation illustrating the incorporation of a customized ply into a composite assembly. In FIG. 11, a roll of customized ply 40 mounted on a roller 42 is uncoiled and fed into the method to form a composite assembly 44. The customized ply 40 includes regions or stripes of ply 46, 46' having different characteristics (e.g., having one or more of different fiber types, number of layers, density, orientation, and so forth). Multiple regions within any one customized ply 40 can have the same characteristics, which are determined based on the intended use of the composite assembly. For example and as shown in FIG. 11, a region 46 of more dense high quality continuous fiber reinforcement is alternated with regions 46' of less dense low quality short chopped fiber reinforcement.

Figure 12:
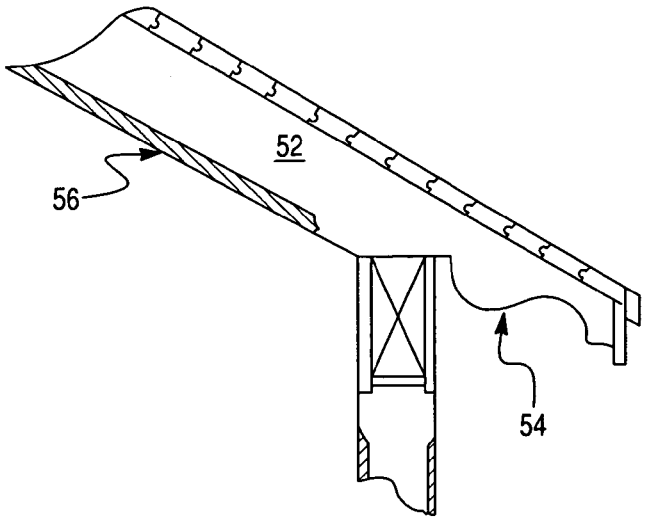
FIG. 12 is an exemplary embodiment of porch rafter made from a strip of composite assembly.
Figure 13:
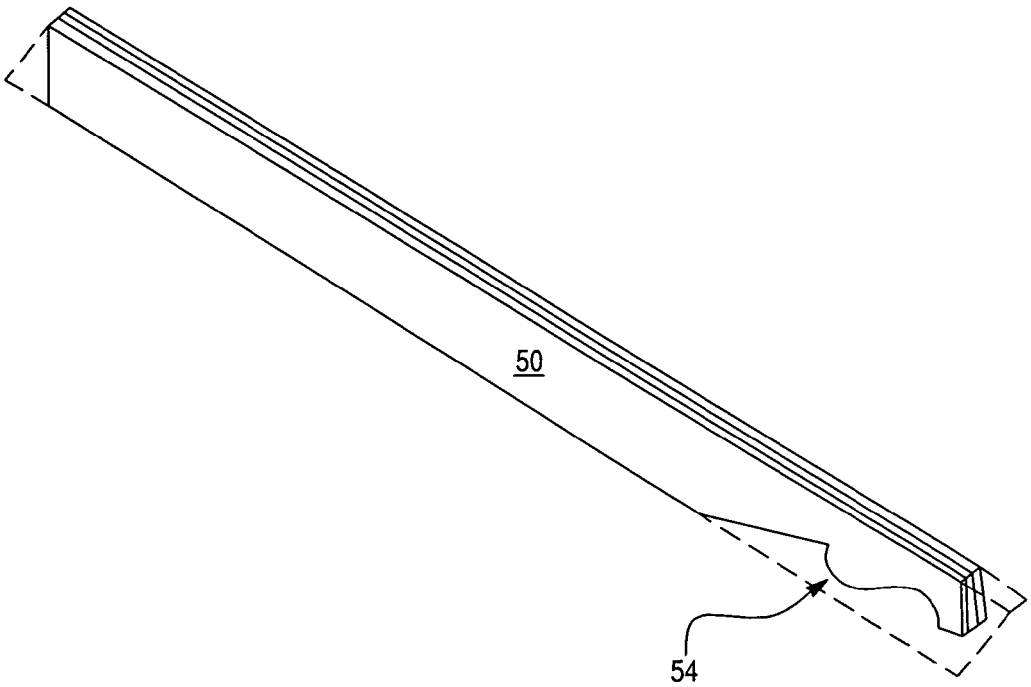
FIG. 13 is an exemplary strip of composite assembly.

For economic and production efficiency, the assembly dimensions may be defined such that once complete and cured, the assembly can be cut to provide multiple component strips, each having the same composition. The dimensions of materials and/or an assembly of materials is only limited by there handling qualities both during and after being combined. For example and as shown in FIG. 11, the regions 46 of more dense high performance reinforcement, when incorporated into the composite assembly 44, are contained within the areas which are ripped to form strips 50. In the strip 50, the regions 46 of more dense continuous fiber reinforcement are at locations subject to high stress. The strip 50 with the regions 46 of high performance reinforcement at an edge may then be processed into a building component, such as porch rafter 52 of FIG. 12, by making the appropriate detail cuts 54, such as scroll work, on the strip 50, as seen in FIG. 13.

The following examples are illustrative of the composite assembly, structures formed from the composite assembly, methods of forming the composite assembly and methods of further processing the composite assembly. They are illustrative and non-limiting. The composite assembly can be used to form any structure presently formed using wood-based products.

PROFILE FOR WINDOW SASH FRAME: One exemplary application described herein is one that may be used to construct a composite assembly for the manufacturing of a window sash frame. This example includes a brief description of the material being replaced, a description of the process used to select the components of the new composite, a description of how to construct a sheet of the composite assembly, a description of how to modify the sheet into the desired strips that match in dimension the material being replaced, and finally how that strip of composite assembly would be used to reproduce the sash profile being produced.

Figure 14:
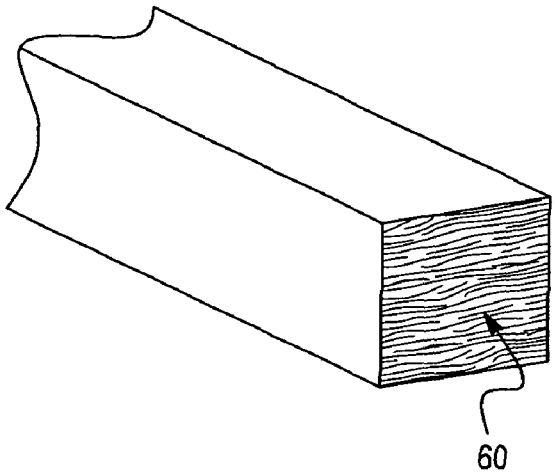
Fig. 14 Prior Art
FIG. 14 is a partial perspective view of a conventional lumber blank.
Figure 15:
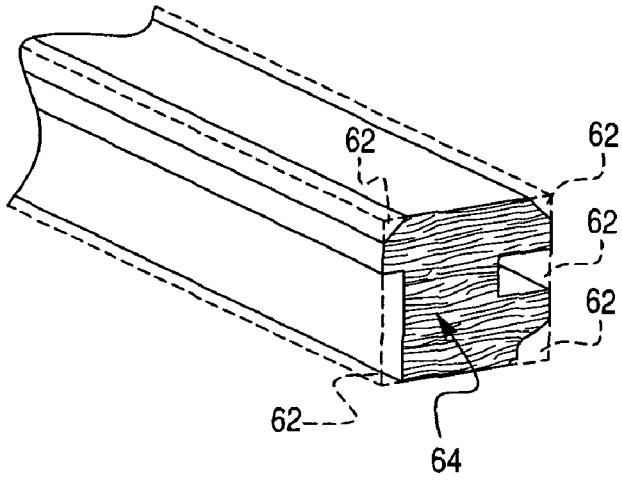
Fig. 15 Prior Art
FIG. 15 is similar to FIG. 14, created by removing portions of the lumber blank to form a profile.
Figure 16:
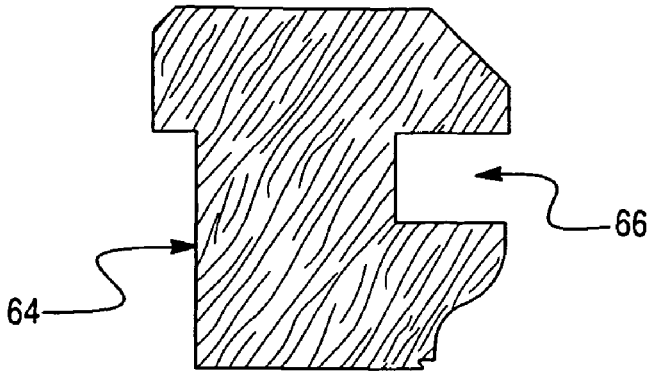
Fig. 16 Prior Art
FIG. 16 is a cross section view of the profile of FIG. 15.

It should be understood that in traditional, time-tested applications, a window sash frame is fabricated completely from conventional high quality lumber, such as yellow pine. FIGS. 14-16 are instructive in that they show the traditional formation of window sash frame from a blank of lumber. The blank of lumber 60, measuring approximately 1¾" thick by 1¼"-3½" wide by varying lengths is run through one or several rotary cutting blades that remove certain portions 62 of the blank 60. Depending on the geometry of the specific cutters used, this produces a specific profile 64, much the same way a molding profile is run. These profiles 64 are then combined with others to form the sash frame that surrounds the glass pane(s). As seen in FIG. 16, the profile 64 has a channel 66 in which the glass panes sit in the assembled window sash frame.

As is commonly understood, wood is prone to deteriorate when exposed to environmental conditions. Further, recent products that use materials that have improved resistance to weather related deterioration, often lack an authentic look and feel of wood. The purpose of this example method is to construct a composite assembly to replace the lumber blank that would otherwise be used to produce the profile of the window sash frame. This stock, however, should possess the desirable look and feel of wood without sacrificing weatherability, workability, or performance qualities.

Figure 17:
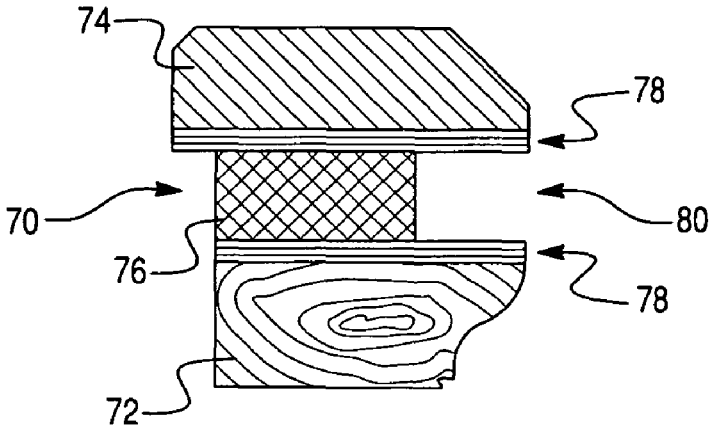
FIG. 17 is a schematic representation of an exemplary embodiment of a profile for a window sash frame where the profile is formed from a composite assembly.

FIG. 17 is a schematic representation of an exemplary embodiment of a profile 70 for a window sash frame. The profile 70 is formed from a composite assembly. The exemplary specifications of the desired characteristics are as follows: This particular product requires an exterior surface that exhibits an authentic look and feel of wood. The exterior will be painted and needs to be a moisture resistant, as well as dimensionally and thermally stable. This contributes to providing a low maintenance exterior with an authentic look and feel. The interior in this case is wood, such as clear Douglas fir, to be stained and polyurethaned after installation to match other interior trim finishes. It must also meet the performance requirements and tolerances for common double hung window dimensions. The resulting composite profile 70 has three layers of substrate: a wood interior layer 72, a high quality cellular PVC, such as AZEK™, as the exterior layer 74, and a core (middle) substrate layer 76 of cellular PVC or other weather resistant filler material. The core substrate 76 serves as a filler and does not need to exhibit the same specific physical properties as the exterior layer. Therefore, lower quality materials such as those mentioned in the preceding description of various substrate materials may be used in place of a high quality CPVC as the ¾" middle layer. The underlying composite assembly has three distinct substrates combined and reinforced with two $FRP_s$ layers 78.

A channel 80 is formed in the profile 70. In some exemplary embodiments, the core substrate layer 76 has a thickness corresponding to a thickness of the glass or other framed panels portion of the window. The core substrate layer can be removed at an edge to form the channel 80 to received the glass portion of the window and thereby frame the glass window. The channel 80 can be reinforced on one or both sides by retaining the $FRP_s$ layer 78 on one or both sides of the channel 80. The retained $FRP_s$ layer 78 can be the entire thickness of the $FRP_s$ layer or can be a portion of the thickness.

Components that can be used to construct the composite assembly to be formed into, among other things, an exemplary embodiment of a profile for a window sash frame include: Two of the substrate layers are cellular PVC (i.e.

AZEK™) sheet product, measuring 2'×12'×¾", and 2'×12'×½" respectively. They will make up the middle (core) layer and exterior layer of the composite. For economic and production efficiency, the overall assembly dimensions of this example is sized to be ripped into seven strips of composite (FIG. 7, where $W_n$=±3"). These strips are dimensioned as blank stock (±1¾"×±3") that is to be run through a rotary type shaper blade to produce the final profile for the sash. The remaining substrate is comprised of variable width, 12' lengths, ¾" thick of clear Douglas fir lumber glued together along their long edges using common methods, to form a 2'×12'×¾" sheet. The fiber used is a woven, unidirectional (having its fibers generally oriented parallel to the length of the sheet), fiberglass fabric (approx. 7 oz. gauge) supplied in a roll. The width of the fabric may be slightly less than that of the substrate sheets to reduce droppings of excess resin and/or fiber from the edges. In this case, the width of the fiber is +/−23", being in a roll many tens of feet long. The resin used is a high modulus, low viscosity polyester blend to be mixed with a time dependant catalyst, e.g., methyl ethyl ketone (MEK), to achieve the cross linking curing process. This type of catalyst can be formulated to cure at a range of time intervals. Adequate time must be allowed to complete the assemblage of the layered assembly before the activated resin cures.

Prior to the reinforced lamination process, the substrates are first "prepared" as previously defined herein. The surface preparation process can take place any time prior to proceeding steps. The ¾" core sheet has both sides run through a surface planer. The thickness of this layer is defined by the thickness of the glass component of the window. The ½" AZEK™ sheet requires only one side run through a surface planer. Most cellular PVC's have a denser layer (smaller cells) of material at the surface, often less than 1/16" thick. Once enough material is removed to expose larger, more typical cells size, little benefit is gained by exposing deeper material. The wood sheet is preferably first run through a surface planer to achieve an even surface, then if necessary, abraded with a low-grit sanding belt. Even high quality natural substrates (i.e. wood) have the tendency to cup or warp slightly. This would require a larger compressive force to be applied to the assembly during curing to insure adequate contact between layers. A surface planer can improve this condition. Further, as a result of being planed, the cells of some wood species also have a tendency to become crushed or compressed. An abrasive, such as low grit sandpaper (i.e., 60 grit), is often adequate to roughen the surface. It should be understood the best preparation method will vary and is easily determined through simple experimentation.

One of the two outermost layers of substrate, in this example the wood sheet, is placed on the staging area with its prepared surface facing upwards. For this example, the staging area used to support the layered assembly is a flat surface, similar in appearance to a bench or table. For other applications, the staging surface may be slightly curved with respect to its length, as may be the case for a pre-stressed beam.

An even coating of resin and catalyst is applied. It can be applied to the surface with a spray device passing over the substrate, by manual or mechanical means. The thickness of the coating is comparable to that of a single coat of paint that would be applied by roller to a typical wall surface. The resin and catalyst may be dispensed separately. They also may be dispensed simultaneously but mix during the dispensing process. As an alternative, the liquid polymer components can be premixed and applied manually using a conventional brush or roller and pad.

The liquid mixture is manipulated with, for example, a rubber or metal "squeegee" type tool or blade to insure adequate mixing (resin and catalyst), consistent spreading, and improved penetration of the liquid into the void spaces of the braised substrate surface. For substrates that are very porous and/or polymer resins that are highly viscous, additional manipulation as described may not be necessary because adequate penetration may be achieved.

A single ply of fiberglass fabric is placed over the wet surface. In this application, the fabric can be applied by passing the roll as it rotates, over the stationary sheet of substrate. The fabric is cut with a shearing or other blade after the proper length of fabric is laid. For smaller applications, the fabric can be cut to size and placed by hand. For more complex composites (i.e. structural bending members), the type and amount of fiber placed may differ throughout the surface and/or be tensioned; having tension maintained until the polymer resin has cured.

The fabric is then saturated. It can be saturated with the resin/catalyst liquid by the same apparatus and technique as previously described. Enough material is applied to allow for complete encasement of the fibers. This amount will vary depending on the specific application.

The saturated mat is optionally rolled, by manual or mechanical means, with a metal corrugated roller or similar tool to fully impregnate the fibers by displacing trapped air. Also, this process forces the fiber down into the liquid, which in turn brings a layer of resin to the surface. This improves the bond strength to items placed on top.

A second single ply of fiberglass fabric is placed over the wet surface in the same manner as the first. The fabric is saturated with the resin/catalyst mixture in the same manner as described for the first. The saturated mat is optionally rolled in the same manner (by manual or mechanical means), with a metal corrugated roller or similar tool to remove trapped air and to bring a layer of resin to the surface. If desired, additional plies of various fibers may be added by repeating the process described until the desired thickness or arrangement is achieved. Typically, two plies are used in a standard composite assembly, but more plies can be used as desired.

The middle (second) substrate layer, having one of its prepared surfaces coated at a separate location, with resin/catalyst and manipulate as previously described, is placed in a manner so as to minimize trapped air on top with the wet surface facing down. For a composite having only two substrate layers, the top layer needs only one surface prepared.

The top surface of the second substrate layer is to be processed in the same manner as the first substrate layer having two plies of fiber embedded within the curing polymer resin matrix to comprise the second $FRP_s$ layer of composite assembly.

The top (third) substrate layer, having its prepared surfaces coated with resin/catalyst and manipulated as previously described, is placed in a manner so as to minimize trapped air on top with the wet surface facing down. This completes the assemblage of composite assembly. However, for a composite having more than three substrate layers, the third layer has two surfaces prepared, the top of which to be laminated upon. For additional laminations, the process as described is repeated until the desired arrangement is completed.

The composite assembly is then put under generally uniform, moderate pressure (less than 10 lb./ft$^2$) for example with a simple press, while the liquid polymer resin is allowed to cure creating a permanent single sheet. The composite assembly will permanently maintain the geometry it has while it cures. The composite assembly may be pressed to conform to a curved surface until cured. For some enhanced structural applications, the curing stage may optionally be carried out in a heated environment and/or with epoxy resins to provide improved $FRP_s$ performance.

Once cured, the composite assembly is a single flat sheet, having approximate dimensions of approximately 1⅞"×24"×12'. The outer portions of its two long sides, elements 37 of FIG. 8 (and/or short sides) can be removed using a circular saw blade or other means, resulting in an approximate dimension of 1⅞"×22"×12'. This may be necessary due to unintentional factors, such as misalignment of layers or the inconsistency of fiber and resin along the perimeter, or in order to otherwise insure meeting the required specifications. The remaining sheet is then cut into seven 3" strips 12, as represented in FIGS. 6-8, using conventional methods such as being gang ripped (passed at once through several cutting blades spaced at predetermined distances). The strips in this case match the dimensions of the wood blank it is replacing. Being from the same sheet of composite assembly, the strips are of the same composition.

It will be understood by one of ordinary skill in the art that the above description of forming the composite assembly can be used to form a composite assembly for further processing into any form, and that different substrates, plies and resins, as disclosed herein, can be interchanged with those discussed above to customize the composite assembly to the desired end use.

For example and to form a profile for a window sash frame, the resulting composite blank is fed into one or several rotary cutting blades or other known means, to create profile 70 of FIG. 17. This step is no different than what would otherwise be used for the wood blank 60 of FIG. 14. The new profile 70 is then combined with others of the same composition using common woodworking and joinery tools, techniques and methods to construct a window sash frame.

The final profile demonstrates the importance of the selection and placement of each layer. This does not affect the ability to properly combine and reinforce the layers, but rather to achieve a successful end product. The outermost exterior layer 74 provides a durable, paintable, weather resistant cladding. The interior layer 72 meets the authentic natural wood requirements. The middle core substrate 76 is dimensioned such that it corresponds to the thickness of the double paned glass panel the sash frame will surround. That channel 80, being the full thickness of the core layer, is reinforced along both the interior and exterior. The reinforcement of the $FRP_s$ does also provide overall rigidity and stability but is better utilized by being strategically placed on either side of the glass. The resulting profile is an exemplary embodiment of how reinforced lamination can be used to engineer a component or product that combines a wide variety of qualities and characteristics.

Figure 18:
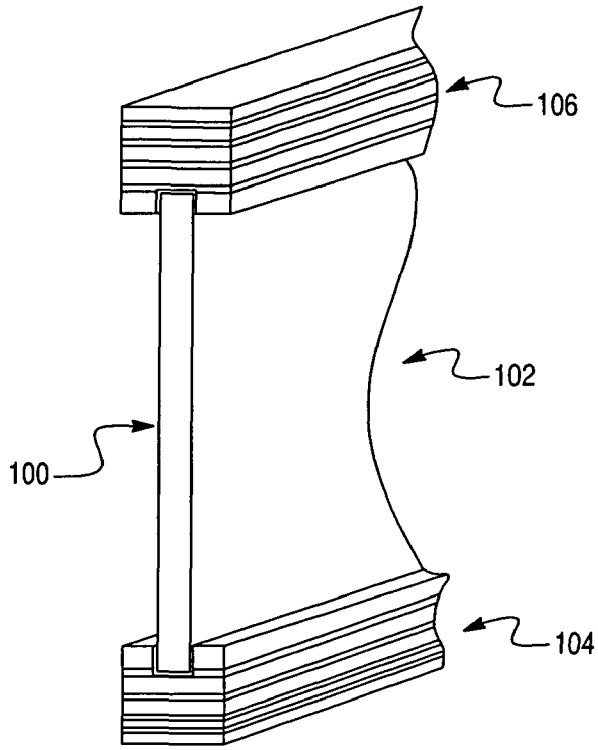
FIG. 18 is a schematic representation of an exemplary I-beam 100 formed using a composite assembly.

I-BEAM: Another exemplary application described herein is one that may be used to construct a composite assembly for the manufacturing of a wood I-beam. FIG. 18 is a schematic representation of an exemplary I-beam 100 formed in part using a composite assembly. The I-beam 100 includes a web 102 connecting a first flange 104 and a second flange 106. Grooves 108 in the flanges 104, 106 accept the web 102. The composite assembly is incorporated into the I-beam 100 in the flanges 104, 106.

Serving as the flanges, the composite assembly must perform to general specifications for loading conditions comparable to common light construction floor systems such as common lumber 2×12 floor joists. In the current industry, the flange component is generally a strip of laminated wood plies measuring approximately 1½" thick by 1½"-3½" wide by varying lengths. They are modified with a dado groove to accept the web of the beam.

As is commonly understood, the upper and lower flanges of an I-beam carry the compressive and tensile stresses respectively. The purpose of this example is to construct a composite to replace the laminated veneer lumber that would otherwise be used to produce the flanges with a reinforced laminated veneer composite. Further, it is commonly understood that an engineered reinforced lamination layer of $FRP_s$ being of equal thickness to a lamination of unaltered wood has considerably greater load bearing capabilities. Also, it is desirable to span greater distances without having to increase the depth of a particular joist. Further, there are practicality limitations to flange size and joist spacing. This composite stock, being of the same dimensions, will possess greater load carrying capabilities. This is accomplished without reducing its ability to be cut, modified or otherwise incorporated into a light construction building system. It can be implemented into existing markets, with respect to both production and installation, using common techniques and methods.

The specifications of the desired characteristics are as follows: The I-beam will measure 1½"×11⅞" by 40' long. It also demands reasonable workability characteristics in that the joists will be cut to final length on site. The upper and lower flanges are to be, generally, indistinguishable (although some applications may have different upper and lower flanges) and measure approximately 2¼" wide×2" tall. The joist requires flanges that also will accept construction adhesive and typically, 8d ring shank nails for the sub-floor decking above and 1⅝" drywall screws for the ceiling below. In the exemplary embodiment of FIG. 18, the composite assembly used for the flanges 104,106 has five similar layers of the substrate 110 and four comparable reinforced lamination layers 112 with $FRP_s$.

A more detailed description of the components used to construct the composite stock is as follows:

All five substrate layers 110 are sheets of laminated veneer lumber measuring 24" wide with two thicknesses of 3/16" and ⅜". These products are produced separately by commonly known means. They are arranged such that two of the outermost layers are the 3/16" thick sheet product and the other three being ⅜" product. For economic and production efficiency, the assembly dimensions of this example allow multiple strips to be ripped out of a single assembly. These strips are dimensioned as blank stock (±2¼"×±2")

The fiber used is continuous s-glass, woven into a fabric sheet. The fabric is supplied in a roll. The width of the fabric may be slightly less than that of the substrate sheets to reduce droppings of excess resin and/or fiber from the edges. In this case, the width of the fiber is +/−23", being in a roll many tens of feet long. Each of the four $FRP_s$ layers will include two plies of fabric applied separately.

The resin used is a high modulus, low viscosity epoxy to be mixed with a time dependant catalyst to achieve the cross linking curing process. This type of catalyst can be formulated to cure at a range of time intervals. Adequate time must be allowed to complete the assemblage of the layered assembly before the activated resin cures.

Prior to the reinforced lamination process, the substrates are first "prepared" as previously defined herein. It is to be understood for this example that the wood veneer lamination manufacturing process includes sanding or some other reasonably acceptable finish as the final surface. It is to be assumed the substrate is supplied with a sufficiently prepared surface.

The assembly process is similar to that previously disclosed herein for forming the composite assembly. One possible variation to the overall process has to do with the continuous high strength fiber. Prior to being pressed and cured, providing the fiber fabric is cut longer than the substrate sheets, these fibers may optionally be grasped at each end and put under tension until the curing is complete. This extra step of pre-tensioning will produce improved reinforcement for a structural member experiencing bending forces such as roof rafters or floor joists.

Once the composite assembly has been cured and trimmed, it is cut into ten strips approximately 2¼" wide. The resulting composite strip has all four sides finished and corners slightly eased (as is common in the industry) and also passed through a dado-cutting machine to remove material for the web groove. Two flanges are attached to a web made of commonly used materials, such as an oriented strand press board, using a means of attachment common to wood I-beam industry.

Figure 19:
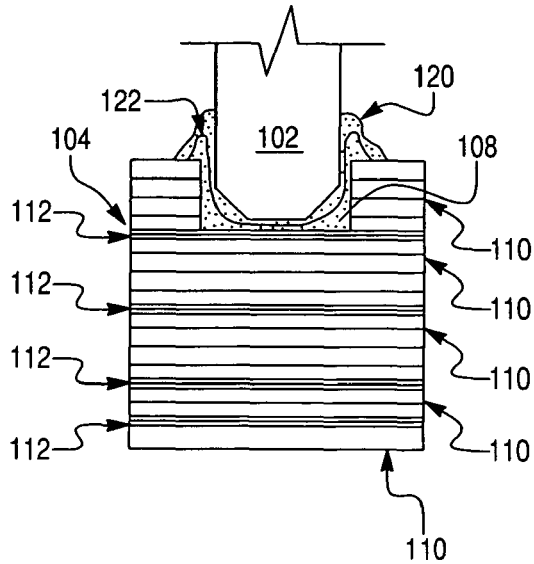
FIG. 19 is an optional alternate method of attachment using a reinforced lamination layer between the flange and the web in an I-beam.

An optional alternate method of attachment is to provide a reinforced lamination between the flange and the web, as see in FIG. 19. First, a moderate amount (determined through simple experimentation) of resin adhesive 120 is dispensed into the bottom of the web groove 108, then a strip of fiberglass tape 122 (+/−1½" wide) is placed over the groove 108, and then the web 102 is inserted into the groove 108. The web 102 pushes the fiber tape 122 down into the resin filled groove 108, in the process displacing the resin and impregnating the fabric tape. Typically, enough resin is used to fully saturate the resin tape.

PORCH RAFTER: Another exemplary embodiment is a porch rafter. Here, a composite assembly may be constructed for the manufacturing of a 2×8 beam of an exposed rafter porch roof (FIGS. 12 and 13). The porch rafter 50 must hold up to general roof loading conditions and be painted to match the color of the house trim. The architectural details require a curved profile cut, e.g., scroll 54, into the rafter tail as well as a 45° camphor 56 along each edge of the rafter's underside.

It should be understood that in traditional, time-tested applications, painted, exposed porch rafters are generally fabricated completely from high quality lumber, such as No. 1 or clear cedar. A blank of lumber measuring approximately 1½" thick by 7½" wide by varying lengths is modified on the construction site using a saber (jig) saw and a router to produce the desired details.

As is commonly understood even properly prepared and painted wood is prone to deteriorate when exposed to adverse environmental conditions. Further, paint grade dimensional lumber has become scarcer and increasingly expensive. The purpose of this example is to construct a composite to replace the lumber stock that would otherwise be used to produce the porch rafter. This stock however will possess the desirable look and feel without sacrificing the stability, weatherability, workability, or performance qualities, all of which are equally important.

The specifications of the desired characteristics of an exemplary embodiment are as follows: The porch rafter will measure 1⅞"×7⅞" by 12' long. It must also meet the performance requirements and tolerances for common framed roof systems. It also demands a stable substrate for accepting and holding paint, as well as being able to be modified on site with common wood working skills and tools. Being that the end product will be painted and low maintenance, the materials used to comprise the composite need to be moisture resistant, as well as dimensionally and thermally stable.

An exemplary composite assembly for fabricating into a porch rafter has three layers of substrate: a high quality cellular PVC, for example AZEK™ products available from AZEK Trimboards of Moosic, Pa., is to be used for both exterior layers as well as the core (middle) substrate layer. The three substrate layers are combined and reinforced with two reinforced lamination layers using $FRP_s$.

A more detailed description of the components used to construct the composite stock is as follows:

The two outermost and the core substrate layers are cellular PVC (i.e., AZEK™) sheet product, measuring 26"×12'×½", and 26"×12'×1" respectively. For economic and production efficiency, the composite assembly of this example is ripped into four strips, each dimensioned as blank stock (±1⅞"× ±7⅞").

The fiber used is a three layer customized fabric similar to that disclosed general in reference to FIG. 11. In more detail here, an exemplary embodiment of a customized fabric a varying layer is sandwiched and pressed using known binding methods between two thin, randomly oriented chopped fiberglass mats to produce a single fabric. The varying layer is an arrangement of differing fiber. Certain enhanced regions along its width have continuous S-glass or carbon fibers oriented parallel to the length of the sheet. Filling the remaining areas of the varying layer are strips of a randomly oriented, chopped fiberglass mat, being of the same thickness so as to create a uniform fabric. The resulting fabric is supplied in a roll. The width of the fabric may be slightly less than that of the substrate sheets to reduce droppings of excess resin and/or fiber from the edges. In this case, the width of the fiber is +/−25", being in a roll many tens of feet long. Each of the two $FRP_s$ layers will include two plies of fabric.

The resin used is a high modulus, low viscosity epoxy to be mixed with a time dependant catalyst to achieve the cross linking curing process. This type of catalyst can be formulated to cure at a range of time intervals. Adequate time must be allowed to complete the assemblage of the layered assembly before the activated resin cures.

Prior to the reinforced lamination process, the substrates are first "prepared" as previously defined herein. The surface preparation process can take place any time prior to proceeding steps. The layers are combined using a similar process to the other product examples disclosed herein. To achieve improved performance qualities, the assembly may optionally be cured at an elevated temperature. Once cured, the sheet 44 of composite assembly has its edges removed and is ripped into four strips 50 as is shown in FIG. 11. Each strip 50 is to be processed into a finished quality board using commonly known tools and techniques, which are used for rafter stock. Each rafter has continuous fiber oriented along portions prone to experience high tensile and compressive stresses (both its uppermost and lowermost edges) to provide the necessary structural requirements.

RAILING COMPONENTS: The application described is one that may be used to construct a composite assembly for manufacturing components of an exterior railing system, such as those used for decks, porches and/or stairs. These components must hold up to general loading conditions, tolerances, and other required safety considerations for spans up to ten feet.

Traditionally, deck and porch railings are fabricated from wood. As a replacement, extruded rigid fiber reinforced thermoplastics and aluminum or wood reinforced hollow vinyl rails have become a low maintenance alternative. Although these substitutes have a place in the industry, they lack an authentic look and feel as well as the ability to be crafted to match a custom profile. The purpose of this example is to create alternate materials to replace the wood stock used to produce these traditional railing profiles. The composites are required to retain the physical and structural characteristics of painted wood. This stock, being of the same dimensions, will possess equal or greater structural performance capabilities while being resistant to the adverse effects from exposure to environmental conditions. Further, it can be produced, installed and finished using common tools, materials, skills, and methods.

The specifications of the desired characteristics are as follows: An exemplary railing system 200 is schematically illustrated in FIG. 20. It should be understood that the considerations used to accomplish this goal could be used to duplicate a wide variety of similar applications. The components of the railing system 200 that require considerations are the main horizontal elements that make up the top rail 202 and bottom rail 204. Of lesser concern, but which may also be manufactured from a composite assembly, are the balusters 206, having varying profiles. Typically, only for specific applications (i.e. longer length) would an increase in strength of the balusters be necessary. For many applications, the balusters may be composed of pre-existing materials such as solid cellular PVC, known to be of adequate strength. For this example, it is to be assumed that a stronger baluster is required. The end product requires a weather resistant surface able to accept a paint finish of common means. It must also meet any and all service loads and conditions. Further, the system is to be provided to the end user in component form, to be modified, assembled, and installed on site using common wood working skills and tools and techniques.

Figure 21:
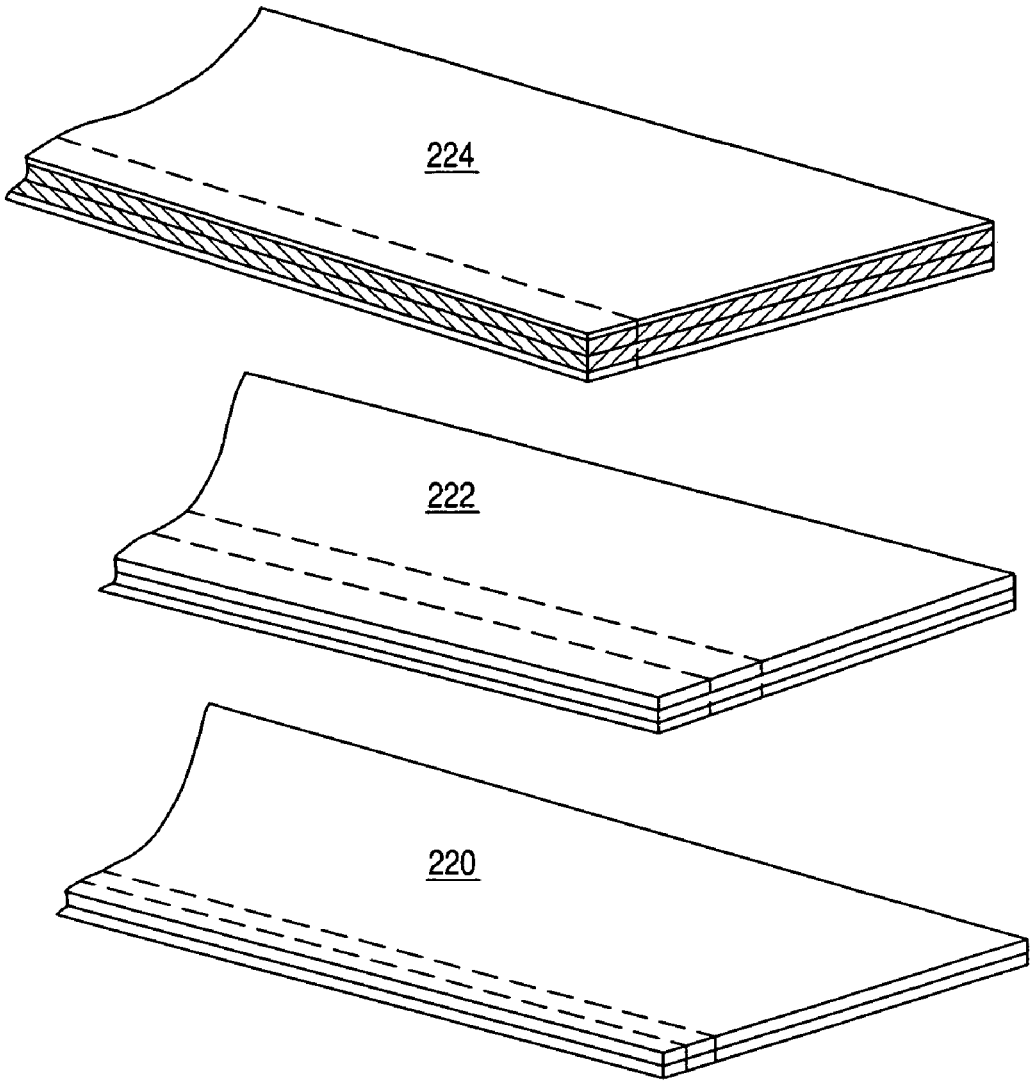
FIG. 21 shows three different exemplary composite assemblies used to produce railing components of the railing system.

In exemplary embodiments, two structural elements are combined to match the geometry of the top rail 202, while a single element is used to serve as the bottom rail 204 and yet another for the balusters 206. The desired components are produced from three different composite assemblies, shown in sheet form in FIG. 21. FIG. 22 shows the railing components arranged in the railing system 200. The balusters 206 are produced from composite assembly 220. As represented in FIG. 22, balusters 206 are combined with non-structural elements 216 and 216' which are composed of pre-existing materials known to be of adequate strength, as a means to connect the balusters to the top and bottom rail sections. The cap 208 of the top rail 202 and the bottom rail components 212 are produced from composite assembly 222, and the remaining top rail component 214 from composite assembly 224.

Composite assemblies for the railing components include two substrates of a high quality cellular PVC or CPVC (such as AZEK™) used as outer cladding, and a core (middle) substrate layer of cellular thermoplastic or other appropriate weather resistant material. The function of the core substrate is as a filler material in that it does not need to exhibit the same specific physical properties as the exterior layer. Therefore, less consistent, lower quality materials may be used.

Assembly 220 has a thickness of approximately 1¾". It consists of two substrate layers and one $FRP_s$ layer. Both substrate layers are 1" thick CPVC sheet product. Assembly 222 has a thickness of approximately 2". It consists of three layers of substrate and two layers of $FRP_s$. One of the outer substrate layers is ½" CPVC, the other is ¾" CPVC, the middle layer is 1" thick CPVC. Assembly 224 has a thickness of approximately 2⅜". It consists of four layers of substrate and three layers of $FRP_s$. The two outermost substrate layers are ½" CPVC sheet product, and the two core layers are ¾" thick filler sheet product.

The fiber used is continuous s-glass, woven into a fabric sheet. The fabric is supplied in a roll. The width of the fabric may be slightly less than that of the substrate sheets to reduce droppings of excess resin and/or fiber from the edges. In this case, the width of the fiber is +/−23", being in a roll many tens of feet long. Each of the two $FRP_s$ layers will include two plies of fabric, The resin used is a high modulus, low viscosity epoxy to be mixed with a time dependant catalyst to achieve the cross linking curing process. This type of catalyst can be formulated to cure at a range of time intervals. Adequate time must be allowed to complete the assemblage of the layered assembly before the activated resin cures.

Prior to the reinforced lamination process, the substrates are first "prepared" as previously defined herein. The surface preparation process can take place any time prior to proceeding steps. Substrates being combined with $FRP_s$ layers on one surface need only that surface prepared and substrates having both sides combined with a $FRP_s$ layer have both surfaces prepared. For this example, all substrate surfaces requiring preparation are passed through a surface planar as the means of preparation. Most cellular PVC's have a denser layer (smaller cells) of material at the surface, often less than 1/16" thick. Once enough material is removed to expose larger, more typical cells size, little benefit is gained by exposing deeper material.

The assembly process is similar to that which has been used for composite assembly 10. Once the assemblies have been cured, they are trimmed and cut into strips. Composite assembly 220 is cut into 1¾" strips, composite assembly 222 is cut into 3¼" strips, and composite assembly 224 into 3" strips. The resulting composite strips or boards cut from the composite assemblies are then passed through four cutting blades, one for each side to true (or square-up) the element, and to eased over the edges to produce a profile commonly used for dimensional lumber. Aside from being cut to length, the baluster element is complete. The other three elements are run through common wood working equipment such as dado cutters, shaping blade cutters and circular blades. The set of profiles is then cut to size and installed on site using common tools and techniques. Once installed, it can be painted using common materials and methods.

Although each of the examples has been described separately herein, it should be understood that features and methods of one example may be incorporated into other examples where desirable to achieve the noted advantages of the features and methods. Further, although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A building material composite assembly, comprising:

an essentially planar first outer substrate that is at least partly porous;

a first reinforced lamination layer;

an essentially planar inner substrate that is at least partly porous;

a second reinforced lamination layer; and an essentially planar second outer substrate that is at least partly porous, wherein the first reinforced lamination layer joins an at least partly porous surface of the first outer substrate to an at least partly porous first surface of the inner substrate, wherein the first reinforced lamination layer includes a pressed mat or fabric containing a plurality of reinforcing fibers and a thermoset resin, the thermoset resin forming a single continuous matrix encasing the plurality of reinforcing fibers and filling pores of the at least partly porous surface of the first outer substrate and filling pores of the at least partly porous first surface of the inner substrate to form a physical anchoring or bonding of the first outer substrate and the inner substrate, the single continuous matrix being formed by the thermoset resin being included in the first reinforced lamination layer as a liquid resin such that excess liquid resin of the first reinforced lamination layer is forced into and fills pores of the at least partly porous surface of the first outer substrate and of the at least partly porous first surface of the inner substrate before the thermoset resin is cured, wherein the second reinforced lamination layer joins an at least partly porous surface of the second outer substrate to an at least partly porous second surface of the inner substrate, and wherein the second reinforced lamination layer includes a plurality of reinforcing fibers and a thermoset resin, the thermoset resin forming a single continuous matrix encasing the plurality of reinforcing fibers and filling pores of the at least partly porous surface of the second outer substrate and filling pores of the at least partly porous second surface of the inner substrate to form a physical anchoring or bonding of the second outer substrate and the inner substrate, the single continuous matrix being formed by the thermoset resin being included in the second reinforced lamination layer as a liquid resin such that excess liquid resin of the second reinforced lamination layer is forced into and fills pores of the at least partly porous surface of the second outer substrate and of the at least partly porous second surface of the inner substrate before the thermoset resin is cured.

2. The composite assembly of claim 1, wherein the single matrix of the thermoset resin contains an anchoring portion of each of the first essentially planar substrate and the second essentially planar substrate, and wherein at least one of the first essentially planar substrate and the second essentially planar substrate is formed from a thermoplastic.

3. The composite assembly of claim 1, wherein at least one reinforced lamination layer is located at other than a neutral axis of the composite assembly.

4. The composite assembly of claim 1, wherein the reinforcing fibers are unidirectional.

5. The composite assembly of claim 1, wherein the reinforcing fibers are multidirectional.

6. The composite assembly of claim 2, wherein the thermoplastic is a cellular polyvinylchloride.

7. The composite assembly of claim 1, wherein the first planar substrate is an outermost layer on a first side and wherein the second planar substrate is an outermost layer on a second side.

8. The composite assembly of claim 1, wherein at least one of the outer planar substrates has a prepared surface.

9. The composite assembly of claim 1, wherein at least one of the first essentially planar substrate and the second essentially planar substrate is formed from a wood-based material.

10. A window sash formed from the composite assembly of claim 9, wherein the wood-based material has a profile formed in a surface and wherein a channel is formed in at least a portion of the composite assembly.

11. A porch rafter formed from the composite assembly of claim 1.

12. A railing assembly formed from the composite assembly of claim 1.

13. An I-beam assembly, comprising:

a first flange formed from the composite assembly of claim 1 and having a groove on a first side;

a second flange formed from the composite assembly of claim 1 and having a groove on a first side; and a web including a first edge seated in the groove of the first flange and a second edge seated in the groove of the second flange.

14. The I-beam of claim 13, wherein the web is joined to at least one of the first groove and the second groove by a reinforced lamination layer.

* * * * *